United States Patent [19]

Katada et al.

[11] Patent Number: 4,562,923

[45] Date of Patent: Jan. 7, 1986

[54] COSMETICS CASE

[75] Inventors: Hirofumi Katada, Suginami; Tetsuya Taniguchi, Meguro; Koji Ikarashi, Yokohama, all of Japan

[73] Assignee: Pola Chemical Industries Inc., Shizuoka, Japan

[21] Appl. No.: 591,331

[22] Filed: Mar. 19, 1984

[30] Foreign Application Priority Data

Mar. 18, 1983 [JP] Japan ..... 58-39310[U]

[51] Int. Cl.[4] ..... A45C 11/00; A45C 11/34; B65D 83/02; B65D 85/28

[52] U.S. Cl. ..... 206/235; 206/214; 206/371; 206/581; 132/79 C

[58] Field of Search ..... 206/235, 581, 214, 371, 206/252, 387; 132/79 C

[56] References Cited

U.S. PATENT DOCUMENTS

| | | | |
|---|---|---|---|
| 1,086,065 | 2/1914 | McAdam | 206/252 |
| 2,121,221 | 6/1938 | Fontan | 206/581 |
| 2,294,257 | 8/1942 | Udvarhely et al. | 132/79 C |
| 2,512,476 | 6/1950 | Birnkrant et al. | 132/79 C |
| 4,030,601 | 6/1977 | Ackeret | 206/387 |

*Primary Examiner*—William T. Dixson, Jr.
*Attorney, Agent, or Firm*—Wenderoth, Lind & Ponack

[57] ABSTRACT

A cosmetics case holds one or more cosmetic pencils in a flat hollow container body having a plurality of openings on one side to receive the cosmetic pencils, lipsticks, or the like. A holding body is slidable in the container body and releasably holds the cosmetic pencils or the like. The holding body slides between a retracted position and a projected position which projects a portion of the cosmetic pencils or the like from the opening. One or more springs urge the holding body to the projected position and a retainer releasably retains the holding body in the retracted position to control the desired position of the cosmetic pencils.

10 Claims, 16 Drawing Figures

COSMETICS CASE

BACKGROUND OF THE INVENTION

1. Field of the Invention

The present invention relates to a portable cosmetics case which receives a plurality of cosmetic pencils in an easily usable manner.

2. Description of the Prior Art

Conventionally, a flat box-like cosmetics case contains a plurality of cosmetic pencils, lipsticks, and the like arranged in parallel. In use, the cover of the case is opened and a selected cosmetic pencil is taken from the case. However, to pick up a cosmetic pencil or the like with its upper half exposed is rather difficult and an impatient lady tends to tip all the cosmetic pencils or the like onto the palm of her hand. Also unrequired cosmetic pencils tend to drop from the case.

SUMMARY OF THE INVENTION

The object of the present invention is to provide an improved cosmetics case to eliminate the above-mentioned disadvantage.

The cosmetics case according to the present invention comprises a flat box-like hollow container body having at least one opening through which a cosmetic pencil, a lipstick, or the like can be inserted in the container body, at least one cosmetic pencil holding body releasably holding at least one cosmetic pencil or the like and adapted to slide in the container body in the longitudinal direction of the cosmetic pencil contained in the holding body between a retracted position in which the contained cosmetic pencil or the like is fully retracted in the container body and a projected position in which a portion of the cosmetic pencil or the like projects beyond the opening of the container body, spring means for urging the holding body to said projected position, and a releasable retainer means for retaining the holding means against said spring means to said retracted position.

The cosmetics case according to the present invention is convenient for carrying selected cosmetic pencils, lipsticks or the like, in a hand bag. As a portion of the cosmetic pencils projects longitudinally from the case by operating the releasable retainer means, a desired lipstick can be pulled out very easily. Also unrequired cosmetic pencils do not accidentally drop out of the case.

BRIEF DESCRIPTION OF THE DRAWINGS

Other objects and features of the present invention will be apparent from the following detailed description of the preferred embodiments, by way of example, and accompanying drawings, in which.

DETAILED DESCRIPTION OF THE PREFERRED EMBODIMENTS

Figure 1:
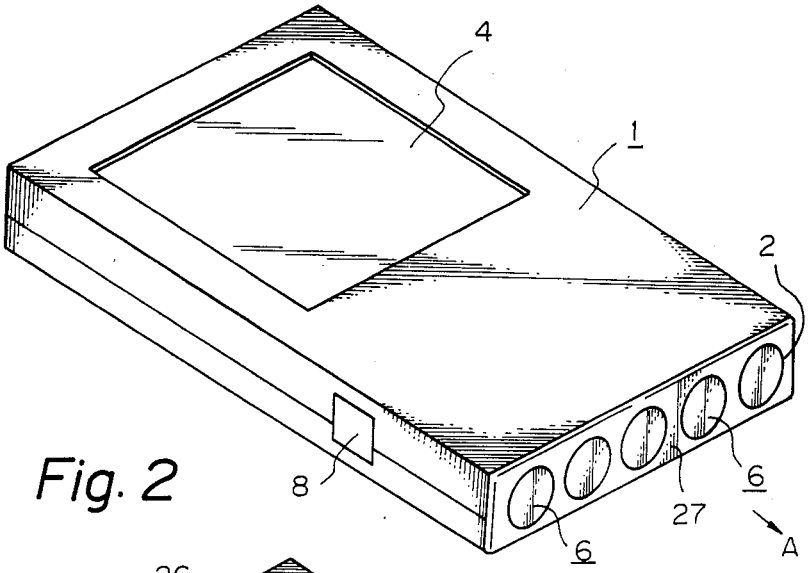
FIG. 1 is a perspective view of a cosmetics case according to a first preferred embodiment of the present invention.
Figure 2:
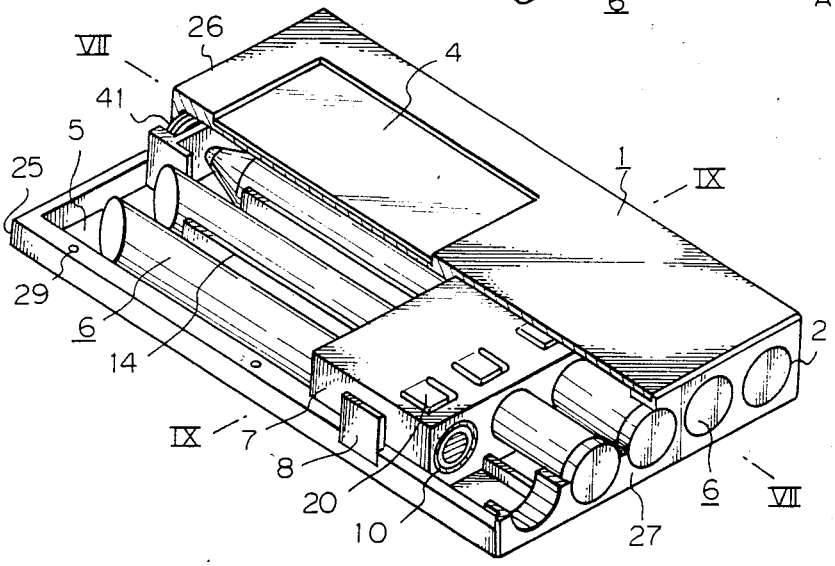
FIG. 2 is a perspective view similar to FIG. 1, a portion of which is broken away.

Referring now to FIGS. 1–11, which show a cosmetics case according to a first embodiment of the present invention, the case comprises a flat cosmetics container body 1 which has a plurality of openings 2 on its front end surface as shown by arrow A in FIG. 1. A cosmetic pencil 6 is removably inserted through each opening 2 into an accomodation space 5 (FIG. 2) formed in the container body 1. As shown in FIG. 2 cosmetic pencils 6 are held by a holding body 7 which is slidably received in the container body 1. The holding body 7 moves forward by operation of a lock knob 8 to expose hand held portions 9 (FIG. 4) of the cosmetic pencils 6 as will be explained in more detail below.

Returning to FIG. 2, the holding body 7 is slidably received in the accomodation space 5 and has a plurality of openings 10 which receive cosmetic pencils 6. The cosmetic pencils 6 can be selected as desired. In the illustrated embodiment, first cosmetic pencils 16, which have telescopic cosmetic 15, e.g. lipstick, and in the illustrated embodiment of FIG. 11, second cosmetic pencils 18, which have pencil-like cosmetic 17, e.g. eyebrow pencil, are shown.

Figure 8:
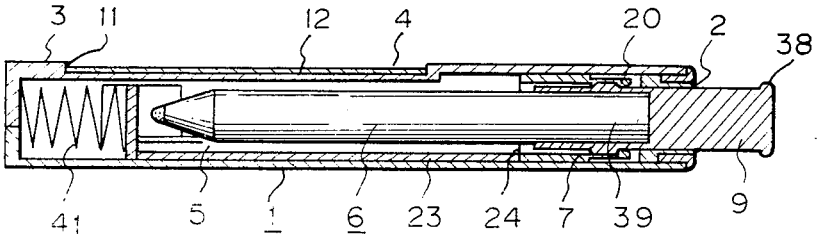
FIG. 8 is a sectional view along line VIII—VIII in FIG. 4.

Returning again to FIG. 2, the container body 1 is formed by a lower box 25, an upper box 26 and a front plate 27 which forms the opening 2 for receiving the cosmetic pencils 6. The container body 1 may be formed of a suitable plastic. As shown in FIG. 8, a surface plate 3 of the upper box 26 (FIG. 2) has a mounting recess 11 for a mirror 4 which is formed of suitable material e.g. plastic, glass or metal plate. The mirror 4 is attached in the recess 11 by a suitable adhesive 12.

Figure 3:
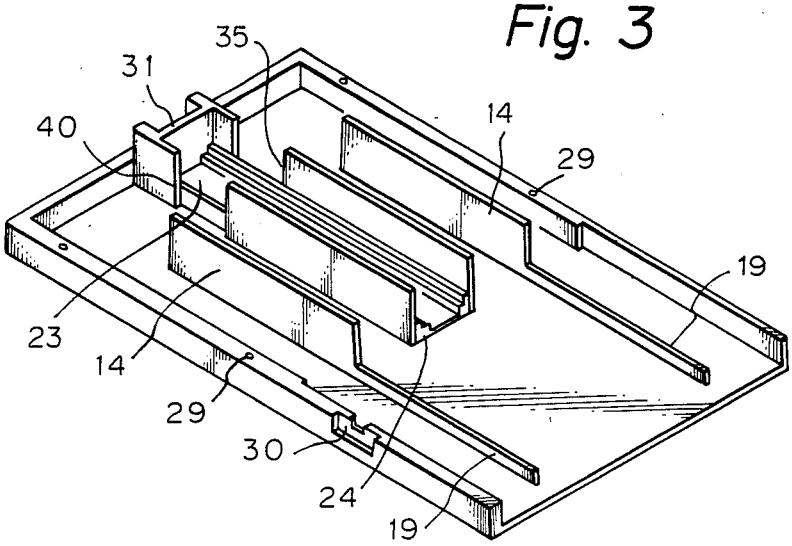
FIG. 3 is a perspective view of a lower box of the container body shown in FIG. 1 with a guide member.
Figure 9:
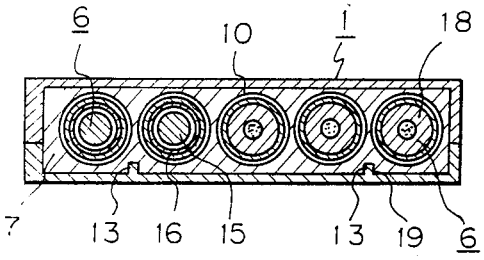
FIG. 9 is a sectional view along line IX—IX in FIG. 2.

In the accommodation space 5 in the container body 1, there is shown in FIG. 9 a plurality of parallel guide rails 19 which engage in guide grooves 13 of the holding body 7 to guide the holding body 7. In FIG. 2, there is also shown partition walls 14. As shown in FIG. 3, the guide rails 19 and the partition walls 14 are formed integrally with the lower box 25 (FIG. 2) and reinforce the container body 1.

Figure 4:
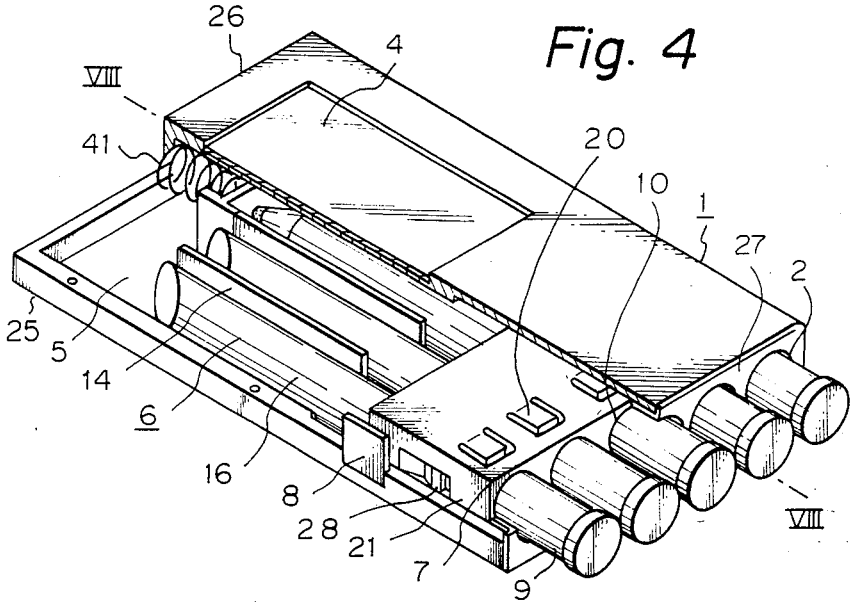
FIG. 4 is a perspective view similar to FIG. 2, showing the projected position of the holding body and cosmetic pencil.
Figure 5:
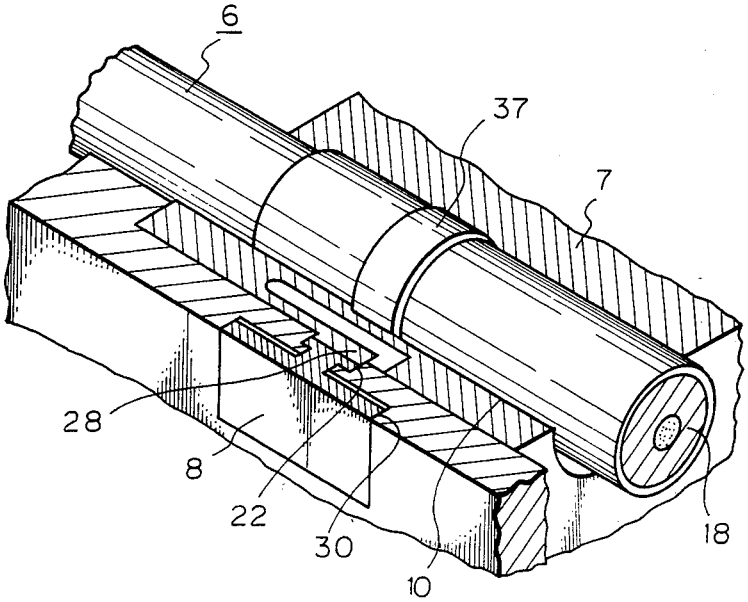
FIG. 5 is an enlarged perspective view of a portion of FIG. 2, a portion of which is broken away to show the retaining means.
Figure 6:
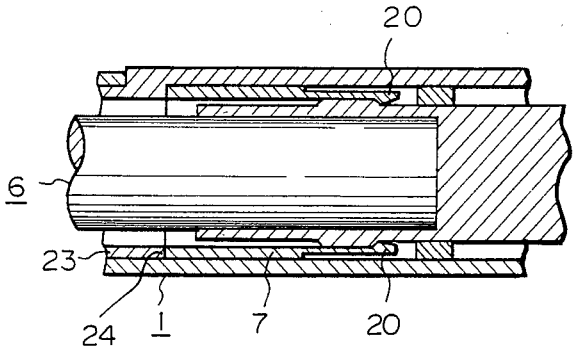
FIG. 6 is an enlarged sectional view of a portion of the holding body.
Figure 7:
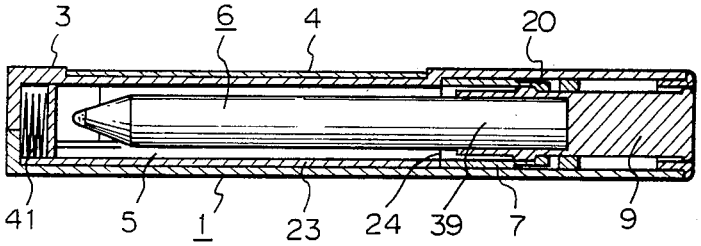
FIG. 7 is a sectional view along line VII—VII in FIG. 2.

Returning once again to FIG. 2, the holding body 7 is formed of a suitable plastic material as that of the container body 1. One or more locking projections 20 are formed on the holding body 7 near the front end of the holding body 7, and project into each opening 10 as shown in FIG. 6. As shown in FIG. 4, on a side surface 21 of the holding body 7 an elastic projection 28 is formed to engage with a recess 22 (FIG. 5) formed on the upper box 26 of the container body 1. Thus, the innermost position of the holding body 7 is limited. As shown in FIG. 3, a guide member 23 is slidably accommodated in the container body 1 between two of the partition walls 14. A compression spring 41 (FIG. 4) is inserted between the rear wall of the container body 1 and the rear end member 31 of the guide member 23 to urge the guide member 23 forward. Thus as shown in FIG. 6, front end 24 of the guide member 23 engages with the rear end surface of the holding body 7. When the elastic projection 28 engages with the recess 22 as shown in FIG. 5, the spring 41 is compressed as shown in FIG. 7. As shown in FIG. 5, when the lock knob 8 is operated to release the elastic projection 28 from the recess 22, the spring 41 urges the holding body 7 forward, as shown in FIG. 8, to project the hand-held portions 9 of the cosmetic pencils 6 from the opening 2.

Figure 10:
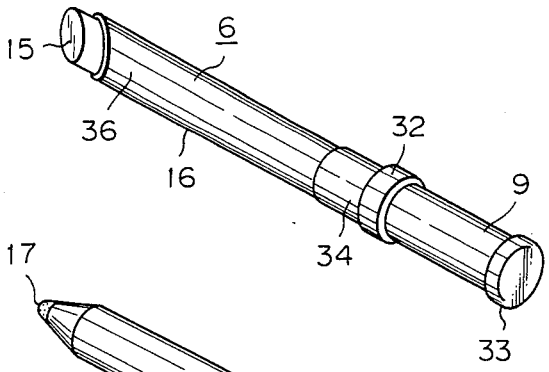
FIG. 10 is a perspective view of a first cosmetic pencil.

The first cosmetic pencil 16 has a cylindrical body 34 which includes, as shown in FIG. 10, a first peripheral lock projection 32 which engages with the lock projection or projections 20 (FIG. 8) of the holding body 7. Returning to FIG. 10 a first pick-up portion 33 is formed as a peripheral projection and is engageable with the opening 2 (FIG. 8) of the container body 1 to protect the accommodation space 5 from dust intrusion. The first pick up portion 33 and adjacent cylindrical portion form the above-mentioned hand-held portion 9. The color of the particular cosmetic pencil 16 or color number may be indicated on the outer surface of the pick up portion 33 or on the cylindrical portion 34, to identify the particular cosmetic pencil. By turning the pick up portion 33, cosmetic 15, e.g. lipstick, projects from or is retracted into the cylindrical cover 36.

Figure 11:
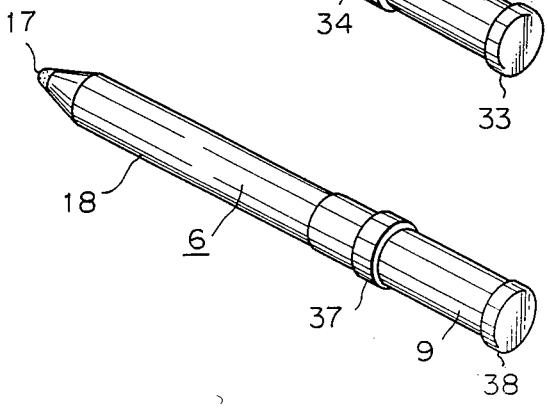
FIG. 11 is a perspective view of a second cosmetic pencil.

The second cosmetic pencil 18 has a cylindrical body 1 as shown in FIG. 11, which pencil 18 includes a second peripheral lock projection 37 which engages with the lock projection or projections 20 (FIG. 20) of the holding body 7 and a second pick-up portion 38 which engages with the opening 2 (FIG. 8) of the container body 1. A pencil-like cosmetic having a cosmetic core 17 is inserted in a hollow opening of the cylindrical body 39 shown in FIG. 8. As discussed before in regard to FIG. 10, the second pick up portion 38 and an adjacent cylindrical portion form the hand-held portion 9 shown in FIG. 11. Also, a particular color or color number may be indicated on the end surface of the pick up portion 38 and/or on the peripheral surface 37 of the cylindrical portion to identify the cosmetic 17.

The container body 1 is assembled by means of alignment hole 29 (FIG. 3). On the side surface of the container body 1, a recess 30 (FIGS. 3 and 5) is formed to receive at least a major portion of the lock knob 8 (FIGS. 4 and 5) to prevent the knob 8 from being accidentally actuated. As shown in FIG. 3, the guide member 23 has end surfaces 40 which engage with end surfaces 35 of the partition walls 14 to define or limit the forwardmost position of the guide member 23. There is shown at 31 is a spring receiving recess.

In the illustrated embodiment of FIG. 1, five cosmetic pencils 6 of the same size are received in the container body 1. However, the cosmetic container may be adapted to receive any suitable member of cosmetic pencils 6, including only one, and also may be adapted to receive a plurality of cosmetic pencils of different diameter.

The spring 41 is shown in FIGS. 2, 4, 7, and 8 as a coil spring. However, a suitable leaf spring may be advantageously used, in place of the coil spring 41. The lock knob 8 is shown in FIG. 5 as being inserted in the recess 30 from the outside. Of course, a suitable means, not shown in the drawing, prevents the knob 8 from dropping off. The lock projections 20 in FIG. 6 and projections 28 in FIG. 5 are shown as urging the projections 20 and 28 radially inwards or sideways by means of the elasticity of the formed plastic material. However, to reinforce this elastic force, a suitable leaf spring, not shown, can be mounted.

Figure 12:
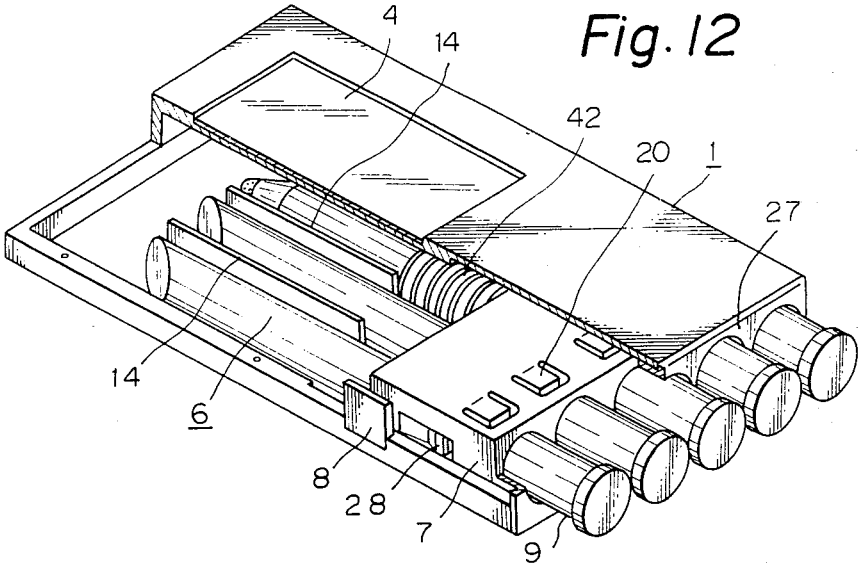
FIG. 12 is a perspective view of a cosmetics case according to a second embodiment of the present invention, a portion of which is broken away.

FIG. 12 shows a second embodiment of the present invention, in which the same reference numerals show the same or similar parts or portions as that of the first embodiment, and repeated explanation will not be necessary. In FIG. 12, a coil spring 42 is inserted between the rear surface of the holding body 7 and two of the partition walls 14 in the container body 1. Thus, the guide member 23 shown in FIG. 3 can be eliminated.

Figure 13:
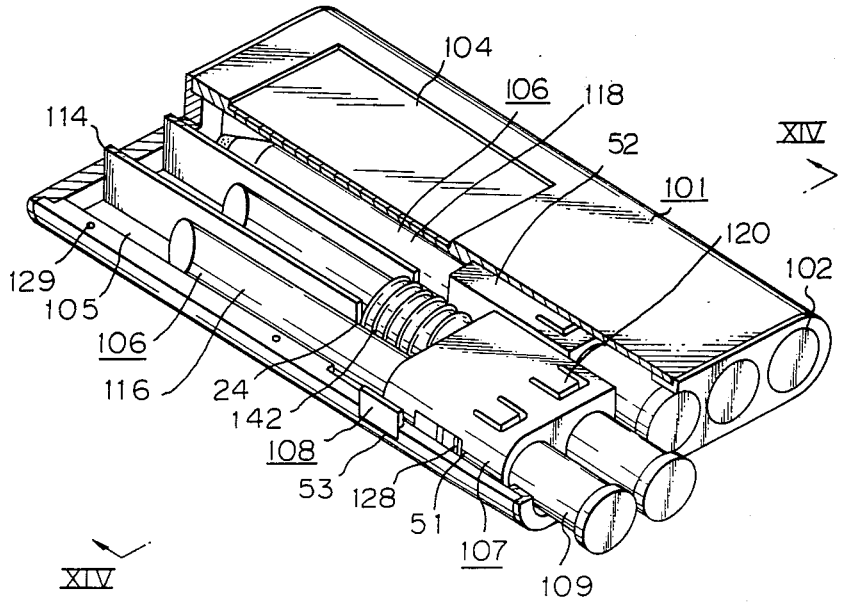
FIG. 13 is a perspective view of a cosmetics case according to a third embodiment of the present invention, a portion of which is broken away.
Figure 14:
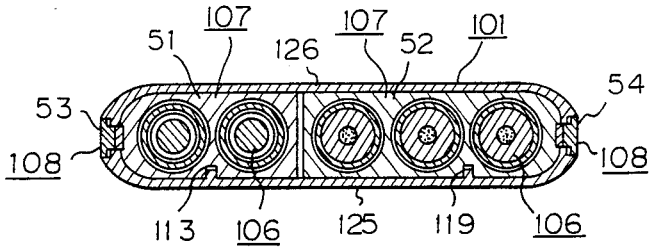
FIG. 14 is a sectional view along line XIV—XIV of FIG. 13.

FIGS. 13 and 14 show a third embodiment of the present invention, in which the reference numerals correspond to those shown in FIGS. 1–12 with the addition of 100 thereto. In this embodiment best shown in FIG. 14, the holding body 107 is divided into afirst holding body 51 and a second holding body 52, and the lock knob 108 is also arranged as a first lock knob 53 and a second lock knob 54. To urge the holding bodies 51 and 52, springs 142, of which only one is shown in FIG. 13, are inserted between the partition walls 114 and the holding bodies 51 and 52, respectively. In the illustrated embodiment of FIG. 13, the first holding body 51 receives two first cosmetic pencils 116 and the second holding body 52 receives three second cosmetic pencils 118.

Figure 15:
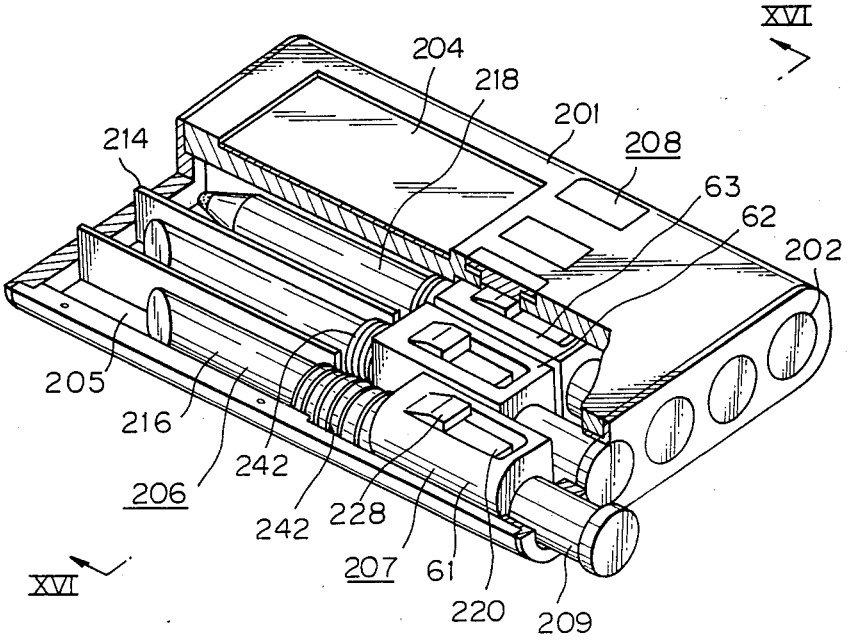
FIG. 15 is a perspective view of a cosmetics case according to a fourth embodiment of the present invention, in which a portion is broken away.
Figure 16:
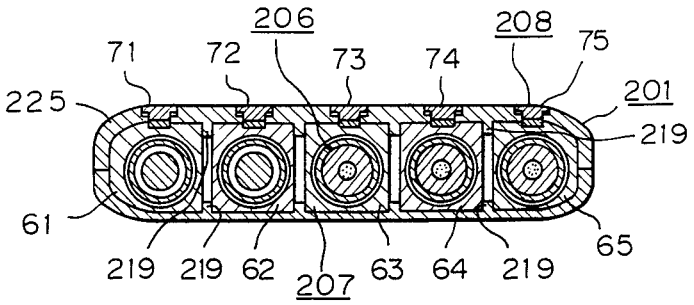
FIG. 16 is a sectional view along line XVI—XVI of FIG. 15.

FIGS. 15 and 16 show a fourth embodiment of the present invention in which the reference numerals correspond to those shown in FIGS. 1–12 with the addition of 200 thereto. As shown best in FIG. 16, the holding body 207 is divided into five holding bodies 61, 62, 63, 64 and 65 which each receive only one cosmetic pencil 206, respectively. Each holding body 61–65 is guided and separated by guide rails 219 formed on the inside surface of the container body 201. The lock knob 208 is formed as five lock buttons 71, 72, 73, 74 and 75 on the upper surface of the container body 201 to operate the desired holding body 61, 62, 63, 64 or 65, independently. Further as shown in FIG. 15, to urge each holding body 61–65 forward, springs 242 are engaged between the partition walls 214 and the holding bodies 61–65, respectively. Although in the embodiment illustrated in FIG. 15, two lipsticks 216 and three eyebrow pencils 218 are shown, the combination can be determined as desired.

As described in detail, the cosmetics case according to the present invention receives one or more cosmetic pencils 6 fully in the container body 1, and no part of the cosmetic pencils 6 is projected beyond the container body 1. Thus, the cosmetics case is very conveniently carried in a hand bag. In operation, by simply operating the lock knob 8, the holding body 7 or one of the holding bodies 107 or 61–65 projects the hand held portion(s) 9 of the received cosmetic pencil(s) 6 from one end of the container body 1. Thus, a desired cosmetic pencil 6 can be pulled from the holding body 7, 107, or 61–65. After use, the cosmetic pencil 6 is inserted in the opening 2 of the container body 1 and is pushed into the holding body 7, 107, or 61–65 to engage the projection 32 or 37 with the lock projection 20, and also to push back the holding body 7 to engage the projection 28 with the recess 22.

The construction of the cosmetics case is very simple and can be manufactured cheaply. The cosmetics case can be easily operated. Cosmetic pencils 6 can be selected and inserted in the cosmetics case as desired.

What is claimed is:

1. A cosmetic case comprising:

(a) a flat box-like hollow container body having side walls and at least one opening in a front end plate;

(b) at least one cosmetic pencil holder means for detachably holding one end of a cosmetic pencil in said container body;

(c) at least one holding body for holding the at least one cosmetic pencil holder means and adapted to slide in the container body in a longitudinal direction of the cosmetic pencil contained in the holder means between a retracted position in which the contained cosmetic pencil is fully retracted in the container body and a projected position in which a portion of said at least one cosmetic pencil holder means projects beyond the at least one opening in the front end plate of the container body;

(d) spring means, provided in the container body, for urging the at least one holding body to said projected position;

(e) first releasable means, provided on the at least one holding body, for engaging with at least one side wall of the container body and for retaining that at least one holding body against said spring means in said retracted position; and (f) second releasable means, provided in the at least one holding body, for engaging with and holding the at least one cosmetic pencil holder means at the projected position of the at least one holding body;

whereby the at least one cosmetic pencil holder means is prevented from being totally projected out of the contaniner body.

2. The cosmetic case according to claim 1, further comprising:

a plurality of cosmetic pencils received in the at least one cosmetic pencil holder means.

3. The cosmetic case according to claim 2, wherein:

said plurality of cosmetic pencils includes a first cosmetic pencil having a painting member on a tip end thereof and a second cosmetic pencil having lipstick on a tip end thereof.

4. The cosmetic case according to claim 2, wherein:

said at least one cosmetic pencil holder means includes a plurality of holder means.

5. The cosmetic case according to claim 4, wherein:

said plurality of holder means, each receiving one cosmetic pencil, are held in the at least one holding body.

6. The cosmetic case according to claim 1, further comprising:

peripheral lock projection means, surrounding the holder means, for engaging with the second releasable means so that the holder means are held to the projected position of the at least one holding body.

7. The cosmetic case according to claim 1, further comprising:

a mirror mounted on the container body.

8. The cosmetic case according to claim 1, further comprising:

a plurality of guide rail means, provided on the inner surface of the container body, for guiding sliding movement of the at least one holding body.

9. The cosmetic case according to claim 1, further comprising:

a partition wall means, extending in a direction parallel to the longitudinal direction of the at least cosmetic pencil contained in the holder means, for reinforcing the container body.

10. The cosmetic case according to claim 1, wherein:

said at least one opening includes a plurality of openings, each having a diameter equal to each other, and each of the cosmetic pencil holder means has a portion with a diameter corresponding to the diameter of each of said plurality of openings.

* * * * *